US008448962B2

(12) United States Patent
Kalyani et al.

(10) Patent No.: US 8,448,962 B2
(45) Date of Patent: May 28, 2013

(54) SYSTEMS AND METHODS PROVIDING VARIABLE SPRING STIFFNESS FOR WEIGHT MANAGEMENT IN A RAIL VEHICLE

(75) Inventors: Amit Rajshekar Kalyani, Bangalore (IN); Munishwar Ahuja, Bangalore (IN); Anubhav Kumar, Bangalore (IN); Ravi Kumar, Tumkur (IN); Krishnarao Dhuri, Bangalore (IN); Nikhil Subhashchandra Tambe, Bangalore (IN)

(73) Assignee: General Electric Company, Schenectady, NY (US)

( * ) Notice: Subject to any disclaimer, the term of this patent is extended or adjusted under 35 U.S.C. 154(b) by 114 days.

(21) Appl. No.: 12/869,572

(22) Filed: Aug. 26, 2010

(65) Prior Publication Data

US 2012/0049479 A1 Mar. 1, 2012

(51) Int. Cl.
*B60G 17/033* (2006.01)

(52) U.S. Cl.
USPC ..... 280/124.101; 267/175; 267/177

(58) Field of Classification Search
USPC ..... 280/5.515, 124.101; 267/174, 175, 267/177.221, 225, 226; 105/218.1, 224.05, 105/224.06, 224.1
See application file for complete search history.

(56) References Cited

U.S. PATENT DOCUMENTS

| | | | | |
|---|---|---|---|---|
| 3,402,923 | A * | 9/1968 | Rhoads et al. | 267/287 |
| 4,616,848 | A * | 10/1986 | Sugasawa et al. | 280/5.518 |
| 4,832,321 | A | 5/1989 | Aardema | |
| 5,044,614 | A * | 9/1991 | Rau | 267/221 |
| 5,553,836 | A * | 9/1996 | Ericson | 267/286 |
| 6,676,118 | B2 | 1/2004 | Chou | |
| 6,676,119 | B2 * | 1/2004 | Becker et al. | 267/218 |
| 6,679,504 | B2 | 1/2004 | Delorenzis et al. | |
| 6,923,299 | B2 | 8/2005 | Barbison et al. | |
| 7,270,222 | B1 * | 9/2007 | Aymar | 188/285 |
| 7,293,764 | B2 * | 11/2007 | Fang | 267/220 |
| 2003/0178758 | A1 * | 9/2003 | Metelski | 267/166 |
| 2004/0094879 | A1 | 5/2004 | Duval et al. | |
| 2006/0131799 | A1 * | 6/2006 | Carlitz et al. | 267/195 |

(Continued)

FOREIGN PATENT DOCUMENTS

| | | | |
|---|---|---|---|
| EP | 65241 | A1 | 11/1982 |
| EP | 791491 | A1 | 8/1997 |

(Continued)

OTHER PUBLICATIONS

Search Report and Written Opinion from corresponding PCT Application No. PCT/US2011/042492 dated Sep. 16, 2011.

*Primary Examiner* — Joseph Rocca
*Assistant Examiner* — Robert A Coker
(74) *Attorney, Agent, or Firm* — The Small Patent Law Group; Evan Reno Sotiriou; Joseph Christian

(57) ABSTRACT

Systems and methods provide variable spring stiffness for weight management in a vehicle. One system includes a plurality of springs and a plurality of spring retainers configured to adjust a number of inactive coils of the plurality of springs. Additionally, a motor is provided that is connected to the plurality of spring retainers and configured to actuate the spring retainers to adjust the number of inactive coils of the plurality of springs. Further, a controller is provided that is coupled to motor to control the motor to actuate the spring retainers to adjust the number of inactive coils of the plurality of springs.

20 Claims, 7 Drawing Sheets

U.S. PATENT DOCUMENTS

| | | | | |
|---|---|---|---|---|
| 2007/0267791 | A1 * | 11/2007 | Hollander et al. | 267/177 |
| 2009/0031916 | A1 | 2/2009 | Kumar et al. | |
| 2009/0095194 | A1 | 4/2009 | Kumar et al. | |

FOREIGN PATENT DOCUMENTS

| | | | |
|---|---|---|---|
| FR | 1289653 | * | 2/1961 |
| FR | 1289653 | A | 4/1962 |
| WO | WO 2009/020698 | A1 | 2/2009 |
| WO | WO 2009/020699 | A1 | 2/2009 |
| WO | WO 2009/020700 | A1 | 2/2009 |

* cited by examiner

SYSTEMS AND METHODS PROVIDING VARIABLE SPRING STIFFNESS FOR WEIGHT MANAGEMENT IN A RAIL VEHICLE

BACKGROUND OF THE INVENTION

Vehicles, such as diesel-electric locomotives, may be configured with truck assemblies including two trucks per assembly, and three axles per truck, for example. The three axles may include at least one powered axle and at least one non-powered axle. The axles may be mounted to the truck via lift mechanisms, such as suspension assemblies including one or more springs, for adjusting a distribution of locomotive weight (including a locomotive body weight and a locomotive truck weight) between the axles.

As the vehicle travels along the rails, the amount of load on each of the axles of the truck can vary, with each axle also having a maximum load weight. In certain conditions, such as during inclement weather, proper traction with the track may be lost, thereby resulting in one or more wheels slipping. Accordingly, the tractive effort for these vehicles may be less than optimized. For example, the tractive effort may be affected on trains, particularly for heavy trains or hauls, during start-up, on inclines, and during adverse rail conditions, such as caused by inclement weather or other environmental conditions.

In known rail vehicle systems, the springs of the suspension systems for the trucks are preloaded. For example, each of the springs is preloaded based on a normal amount of weight to be supported by the suspension system for the axles. As a result, under certain conditions, the preloaded springs may not provide the sufficient normal force to maintain proper contact between the wheels of the truck and the track, especially during inclement or adverse rail conditions.

BRIEF DESCRIPTION OF THE INVENTION

In accordance with various embodiments, systems and methods provide variable spring stiffness for weight management in a vehicle. One embodiment includes a plurality of springs and a plurality of spring retainers configured to adjust a number of inactive coils of the plurality of springs. Additionally, a motor is provided that is connected to the plurality of spring retainers and configured to actuate the spring retainers to adjust the number of inactive coils of the plurality of springs. Further, a controller is provided that is coupled to motor to control the motor to actuate the spring retainers to adjust the number of inactive coils of the plurality of springs.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
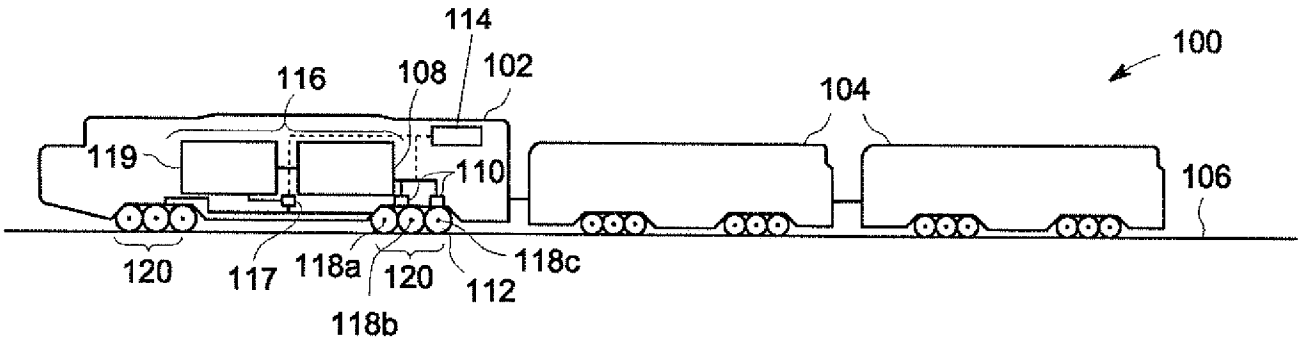
FIG. 1 is a diagram of a powered vehicle formed in accordance with one embodiment.

To the extent that the figures illustrate diagrams of the functional blocks of various embodiments, the functional blocks are not necessarily indicative of the division components. Thus, for example, one or more of the functional blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It should be noted that although one or more embodiments may be described in connection with powered rail vehicle systems having locomotives with trailing passenger or cargo cars, the embodiments described herein are not limited to trains. In particular, one or more embodiments may be implemented in connection with different types of vehicles including wheeled vehicles, other rail vehicles, and track vehicles.

Example embodiments of one or more apparatus and methods for weight management of a vehicle are provided. The various embodiments provide dynamic weight management of a vehicle, which includes changing the load among the axles to redistribute the load on the axles of a truck in the vehicle system. As described below, one or more of these embodiments provide for dynamic weight management of a vehicle that transfers reaction forces among axles of the vehicle, for example, from a middle/center or inner axle to outer axles by varying the stiffness of one or more springs of a suspension system of the vehicle. For example, in some embodiments an arresting mechanism is used to change the number of active coils of the springs by arresting one or more (or a portion thereof) of the coils of the springs.

As used herein, when reference is made to arresting one or more coils, this generally refers to making the one or more coils of a spring inactive or ineffective. For example, arresting one or more coils includes locking or otherwise stopping movement or compression of one or more coils or a portion of the springs, such as by locking the one more coils in place.

By practicing the various embodiments and at least one technical effect is increased traction on the powered axles, which may facilitate the tractive effort during certain traction limited modes of operation. Moreover, by practicing the various embodiments, less traction motors may be used to generate the same amount of tractive force or effort. For example, on a six axle truck, traction motors may be provided on only four of the axles instead of all six axles. Additionally, weight transfer between axles in accordance with various embodiments provides improved contact and traction between the rail and the wheel, which allows the truck of the vehicle to haul heavier loads, such as hauling a load with less traction motors.

FIG. 1 is a diagram of a powered rail vehicle 100 formed in accordance with one embodiment, illustrated as a locomotive system wherein transfer of reaction forces among the axles may be provided by varying the stiffness of one or more springs of the suspension of the locomotive system. For example, as described in more detail herein and noted above, a spring retainer may be used to arrest and change the number of active coils of a spring suspension to vary the stiffness of the springs of the suspension.

While one embodiment of the presently described subject matter is set forth in terms of a powered rail vehicle, alternatively the subject matter may be used with other type of vehicles as described herein. The rail vehicle 100 includes a lead powered unit 102 coupled with several trailing units 104 that travel along one or more rails 106. In one embodiment, the lead powered unit 102 is a locomotive disposed at the front end of the rail vehicle 100 and the trailing units 104 are cargo cars for carrying passengers and/or other cargo. The lead powered unit 102 includes an engine system, for example, a diesel engine system 116. The diesel engine system 116 is coupled to a plurality of traction motors 110 to provide tractive effort to propel the rail vehicle 100. For example, the diesel engine system 116 includes a diesel engine 108 that powers traction motors 110 coupled with wheels 112 of the rail vehicle 100. The diesel engine 108 may rotate a shaft that is coupled with an alternator or generator (not shown). The alternator or generator creates electric current based on rotation of the shaft. The electric current is supplied to the traction motors 110, which turn the wheels 112 and propel the rail vehicle 100. It should be noted that for simplicity and ease of illustration, the traction motors 110 are only shown in connection with one set of wheels 112. However, traction motors 110 may be provided in connection with other wheels 112 or sets of wheels 112 as described herein.

Figure 4:
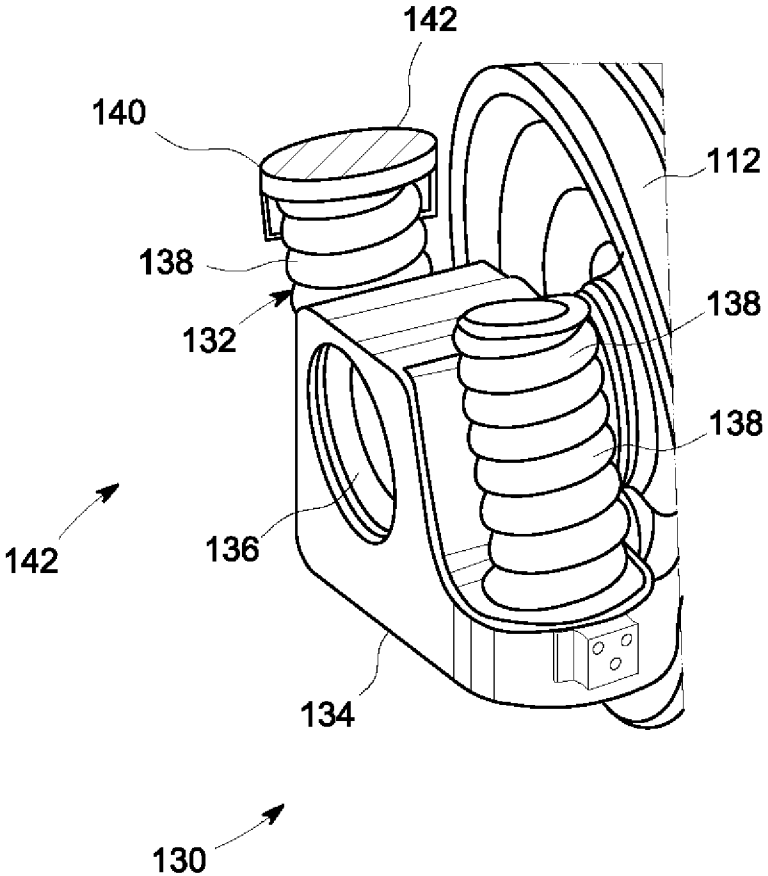
FIG. 4 is a diagram of a variable spring stiffness arrangement formed in accordance with various embodiments.

The rail vehicle 100 includes a controller, such as a control module 114 that is communicatively coupled with the traction motors 110 and/or an actuator 117 for controlling the stiffness of springs 132 of a suspension system 142 (both shown in FIG. 4). For example, the control module 114 may be coupled with traction motors 110 and/or the actuator 117 by one or more wired and/or wireless connections. The control module 114 operates in some embodiments to control and redistribute the load supported by the each of the wheels 112, and more particularly, each axle 118 by varying the stiffness of one or more coils or a portion of the springs 132, such as by immobilizing or arresting one or more coils 138 of the springs 132 (shown in FIG. 4).

In various embodiments, dynamic weight management may provide load distribution independently to each of the axles 118. For example, each of the units 102 and 104 may include two sets of wheels 112 corresponding to two trucks 120 (shown more clearly in FIG. 2). As illustrated, each truck 120 includes three axles 118, with each having two wheels 112. In some embodiments, the outer axles 118*a* and 118*c* are powered by a traction motor 110, with the inner axle 118*b* not powered by a traction motor 110. Accordingly, for a particular unit 102 or 104, traction motors 110 are provided in connection with a total of four axles 118 instead of all six axles 118. It should be noted that the number of traction motors 110 and which axles 118 are connected to the traction motor 110 may be modified such that different configurations of tractive power may be provided.

The control module 114 may include a processor, such as a computer processor, controller, microcontroller, or other type of logic device, that operates based on sets of instructions stored on a tangible and non-transitory computer readable storage medium. The computer readable storage medium may be an electrically erasable programmable read only memory (EEPROM), simple read only memory (ROM), programmable read only memory (PROM), erasable programmable read only memory (EPROM), FLASH memory, a hard drive, or other type of computer memory.

Figure 2:
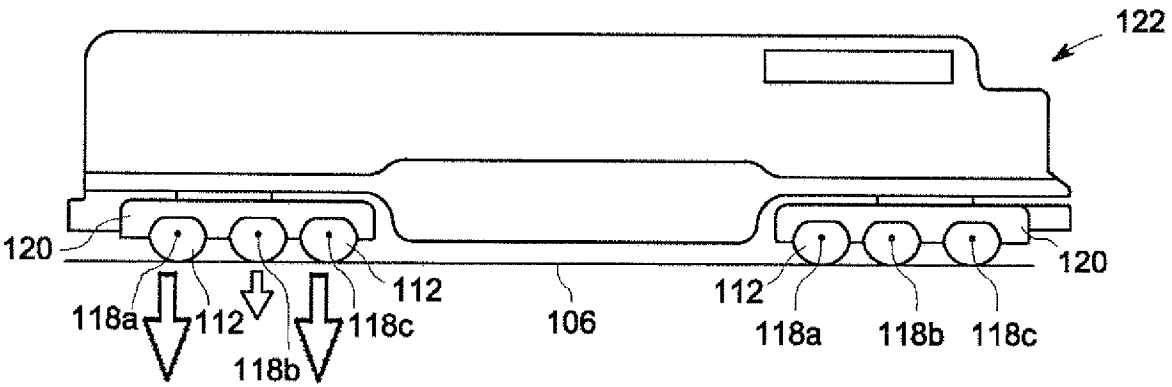
FIG. 2 is a side view of a vehicle having trucks with variable spring stiffness suspensions in accordance with various embodiments.

Thus, as illustrated by the locomotive 122 shown in FIG. 2, weight management, which in various embodiments includes weight transfer or redistribution may be provided, such as when the wheels 112 are slipping relative to the rails (e.g., track) 106. In accordance with various embodiments, weight management is provided, such that weight from the inner or middle axle 118*b* is redistributed to the outer axles 118*a* and 118*c*, illustrated by the larger arrows corresponding to the outer axles 118*a* and 118*c* and the smaller arrow corresponding to the inner axle 118, which represents a change in the weight or load on each of the axles 118*a-c*. The increased weight on the outer axles 118*a* and 118*c* results in increased traction of the wheels 112 of the axles 118*a* and 118*c* with the rails (e.g., track) 106, which reduces the amount of wheel slip, such as during traction limited modes of operation. Thus, the control module 114 may provide dynamic weight redistribution among the axles 118*a-c*. It should be noted that weight redistribution may be provided in connection with any unit of the rail vehicle system.

The weight redistribution in some embodiments includes a transfer of the weight from the inner axle 118*b* equally to the outer axles 118*a* and 118*c*. The weight redistribution is provided by changing or varying the stiffness of the springs 132 in connection with the suspensions for one or more of the axles 118*a-c*. For example, in some embodiments, four springs 132 are provided per axle 118*a-c*. However, weight management including the redistribution of weight is achieved by changing the stiffness of some, but not all of the springs 132.

Figure 3:
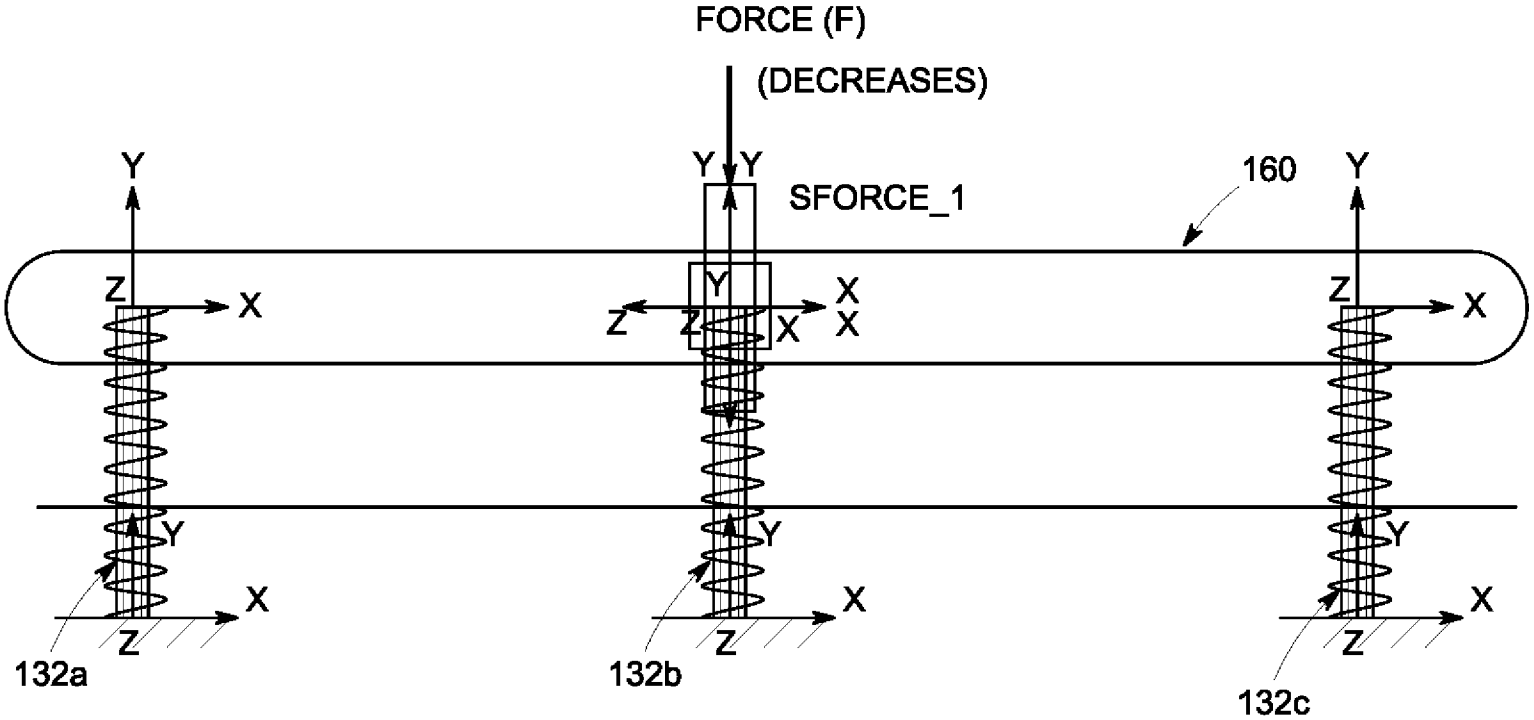
FIG. 3 is a diagram illustrating a redistribution of load using springs in accordance with various embodiments.

Referring to FIGS. 3 and 4, various embodiments redistribute weight among the axles 118*a-c*, for example, by changing the number of active coils 138 for one or more of the springs 132, which changes the stiffness of the springs 132. Thus, a stiffness of the springs 132 is changed such that a load redistribution results. For example, in one embodiment as illustrated in FIG. 4, a variable spring stiffness arrangement 130 is illustrated forming part of the suspension system 142. It should be noted that like numbers represent like parts in the Figures. The variable spring stiffness arrangement 130 includes a mechanism for changing a stiffness of one or more of the springs 132 of the suspension system 142 of the truck 120 (shown in FIG. 2), a portion of which is shown in FIG. 3. An axle box 134 (which also may be referred to as a journal box) is provided having an opening 136 therethrough for receiving an axle, such as the axle 118*a-c* of the locomotive 122 (both shown in FIG. 2) extending also through the wheel 112. In the illustrated embodiment, two springs 132 are provided in connection with each axle side, and thus, a total of four springs 132 are provided in connection with the suspension for each axle 118*a-c*.

Figure 6:
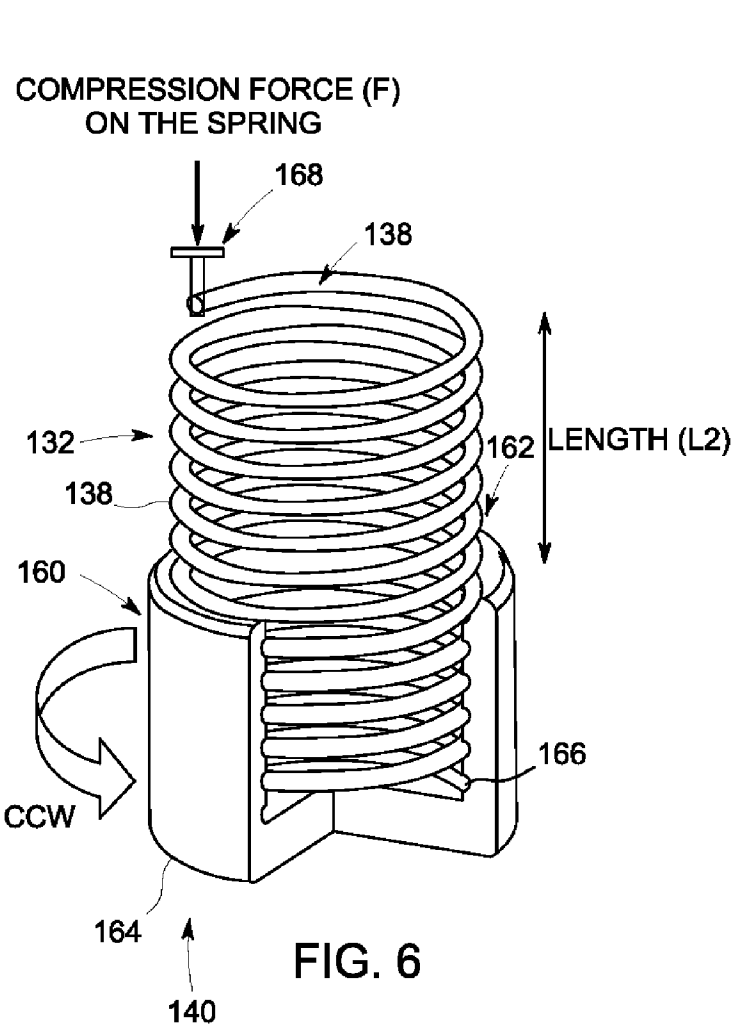
FIG. 6 is another perspective view of the spring retainer formed in accordance with various embodiments and having a different stiffness.
Figure 5:
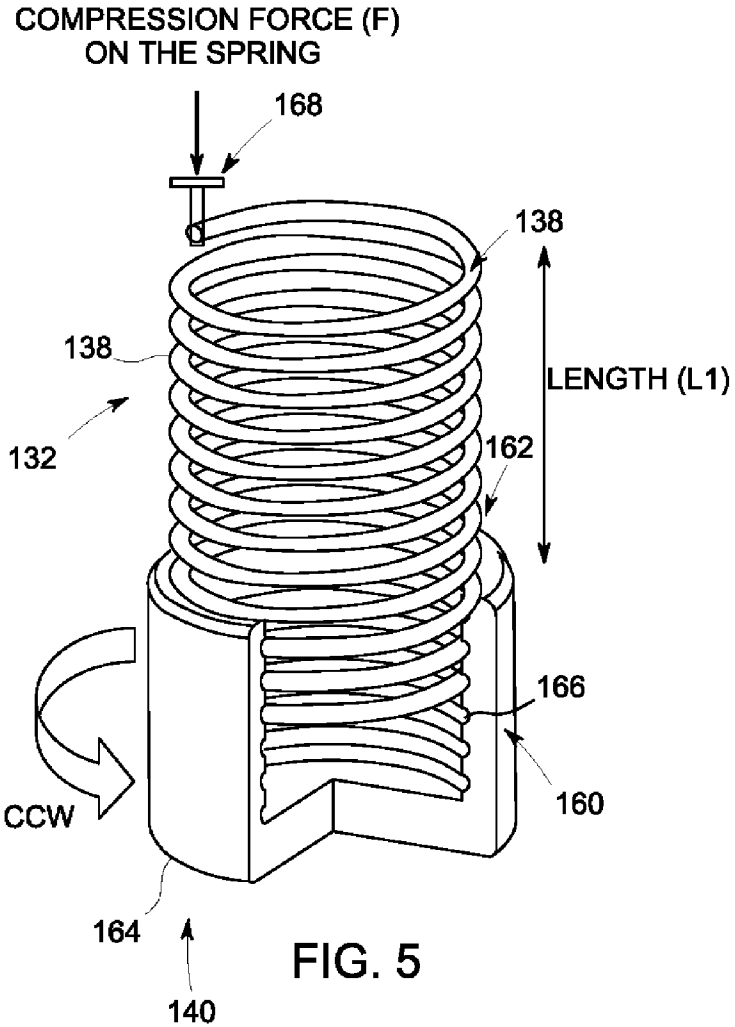
FIG. 5 is a perspective view of a spring retainer formed in accordance with various embodiments.
Figure 7:
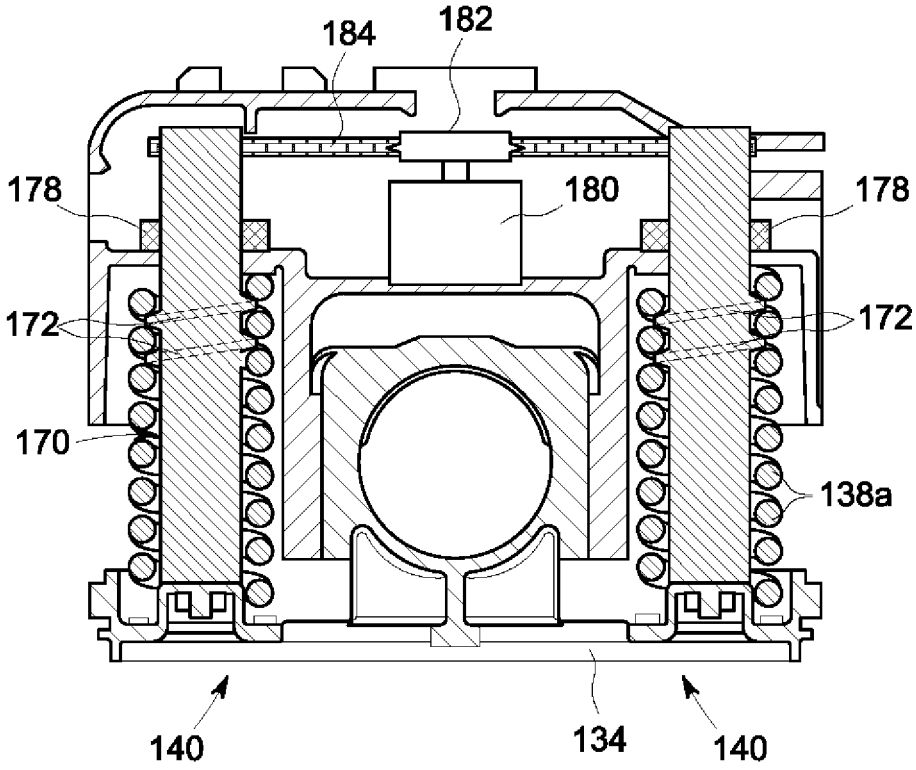
FIG. 7 is a cross-sectional view of another spring retainer formed in accordance with various embodiments within a vehicle suspension.

In one embodiment, as shown in FIG. 4, the mechanism for changing the number of active coils 138 of the springs 132 and thereby adjusting the stiffness of the springs 132 includes a spring retainer 140, which may be configured in different ways. For example, in some embodiments the spring retainer 140 may have a threaded interior region as illustrated in FIGS. 5 and 6 for receiving therein and locking in place one or more of the coils 138. In other embodiments, for example as shown in FIG. 7, the spring retainer 140 may be a retaining bolt or a retaining screw that includes a threaded exterior surface for receiving therein and locking in place one or more of the coils 138. The threads of the spring retainer 140 are configured to be complementary to the coils 138, for example, having generally a same size and pitch as the coils 138.

The spring retainer 140 may be any mechanism that arrests and changes and number of active coils 138. It should be noted that although the spring retainer 140 is shown at a top end of the springs 132, the spring retainer 140 may be located on a bottom end of the springs 132. In the illustrated embodiment, the bottom or lower end of the spring 132 is supported on the axle box 134 using, for example, a spring cap. Thus, the variable spring stiffness arrangement 130 includes a mechanism wherein coils 138 at one end of the springs 132 (illustrated at the top end of the springs 132) are (i) locked, which are referred to as locked or arrested coils or (ii) released to change the stiffness of the springs 132. Any coils 138 that are not locked or arrested are active coils 138.

In FIG. 4, one of the springs 132 (the right side spring 132) is shown without the spring retainer 140 attached and a portion of the spring retainer 140 attached to the left side spring 132 is removed to show the spring 132 therein. The spring retainer 140 may include a coupling end 143 to allow controllable actuation of the variable spring stiffness arrangement 130, such as by the control module 114 (shown in FIG. 1) via the actuator 117, which may be a motor. The controllable actuation in various embodiments causes the variable spring stiffness arrangement 130 to rotate the spring retainer 140, thereby causing more or less of the coils 138 to become arrested depending on the direction of rotation.

Thus, the number of active coils of the springs 132 may be dynamically adjusted, which affects the stiffness of the springs 132 and the corresponding load on the axle 118. In some embodiments, changing of the stiffness of the springs 132 may be initiated based on a user input, for example, based on a user identifying a traction limited mode of operation (e.g., wheel slipping or upcoming rail incline or adverse rail condition). In other embodiments, the changing of the stiffness of the springs 132 may be initiated automatically, for example, based on a sensed or detected traction limited mode of operation using one or more sensor. In these embodiments, upon detecting the traction limited mode of operation or an upcoming traction limited mode of operation, such as based on an identification of the traction limited mode of operation by the sensor, which is communicated to the control module 114, the control module 114 automatically changes the stiffness of the springs 132. A notification of the automatic stiffness change may be provided to an operator, such as via an audible and/or visual indicator.

In the various embodiments, the control module 114 instructs the variable spring stiffness arrangement 130 to change the stiffness of the springs 132, for example, by operating a motor to rotate the spring retainer 140. The rotation of the spring retainer 140 changes the number of coils 138, for example, the number of coil turns that are arrested and, thus changes the stiffness of the springs 132 to redistribute the load among the axles 118 (shown in FIGS. 1 and 2). For example, the control module 114 may cause the spring retainer 140 to rotate clockwise or counterclockwise to arrest more or less coils 138 such that the stiffness of the springs 132 is increased or decreased to redistribute load as illustrated in FIG. 3.

For example, if the spring retainer 140 is rotated to increase the number of active coil turns of the coils 138, the stiffness of the springs 132 decreases. The decrease of the stiffness of the springs 132 causes a shift or redistribution of weight among the axels 118, namely to or from the different axles 118.

More particularly, referring to the example in FIG. 3, showing a portion of a truck platform 150 (which is supported on a standard suspension), if the stiffness of the springs 132 of the inner axle 118*b* is increased by arresting more coils 138, the weight or load is transferred or redistributed from the center axle 118*b* to the outer axles 118*a* and 118*c*. The outer springs 132*a* and 132*c* correspond to the outer axles 118*a* and 118*c* and the inner springs 132*b* correspond to the inner axles 118*b*. The weight redistribution is about equal when the change in spring stiffness is the same. Accordingly, weight redistribution is provided by changing the number of active coils 138 of the springs 132, which changes the stiffness of the springs 132. Also, in the illustrated embodiment, the variable spring stiffness arrangement 130 is configured to change the stiffness of the inner springs 132*b* and not the outer springs 132*a* and 132*c*. However, the variable spring stiffness arrangement 130 and consequently the control of the stiffness may also be provided to different springs, for example, the outer springs 132*a* and 132*c* instead of the inner springs 132*b*, or all of the springs 132*a-c*, or combinations thereof.

The spring retainer 140 may be any suitable device for engaging and retaining (in an arrested state) a portion or some of the coils 138 at one or more ends of the springs 132 for changing the stiffness of the springs 132. For example, the spring retainer 140 may be a threaded cap or cup, or may be a threaded bolt or screw mechanism as described herein. Additionally, the springs 132 may be any type of spring, such as any spring suitable for a locomotive suspension.

In an initial state of stiffness, such as when a traction limited mode of operation is not detected, all of the springs 132*a*, 132*b* and 132*c* have the same stiffness. Thus, all of the springs 132*a*, 132*b* and 132*c* have the same or about the same stiffness. As the stiffness of the outer springs 132*a* and 132*b*, is increased, the net preload on the inner axle 118*b* (center axle) changes and the load or weight is redistributed to the outer axles 118*a* and 118*c*.

The spring retainer 140 may be implemented in different configurations and arrangements. In the various embodiments, the spring retainer 140 may have a threaded interior or a threaded exterior for engaging coils 138 of the springs 132. It should be noted that other spring retention methods or apparatus may be used. For example, the spring retainer 140 may be a locking device or clamping device that can arrest portions of the springs 132.

In general, the various embodiments provide varying spring stiffness using a threaded spring retainer 140. For example, the spring retainer 140 includes a retaining device that may be located at a top or bottom of the springs 132. As illustrated in FIGS. 5 and 6, the movable end of the spring 132 that engages the spring retainer 140 is the lower end with the upper end of the spring 132 being fixed. For example, an actuator operates to rotate the spring retainer 140 to change the stiffness of the springs 132 (only one spring is shown) by changing the number of active coils. In this embodiment, the actuator may be mounted to the axle box or other portions of the locomotive, for example, to the truck frame. In various embodiments, the actuator is only mounted to the outer axles 118*a*and 118*c*, which include the variable spring stiffness arrangement 130. However, the variable spring stiffness arrangement 130 with a corresponding actuator may be provided on different axles, for example, each of the inner axles 118*b*, with the outer axles 118*a* and 118*c* not including the variable spring stiffness arrangement 130.

In the embodiment illustrated in FIGS. 5 and 6, the spring retainer 140 is configured having inner threads. In this embodiment, the spring retainer 140 includes a threaded cap 160 that is capable of rotation. The threaded cap 160 includes an open end 162 for receiving the spring 132 and a closed end 164 defining a base, which limits the maximum number of coils 138 of the spring 132 that can be retained and arrested within the threaded cap 160.

The threaded cap 160 includes one or more inner threads 166 having a size and pitch complementary to the coils 138 of the spring 132 such that when the threaded cap 160 is rotated, the threads 166 engage and retain some of the coils 138 or a portion thereof. It should be noted that the end of the spring 132 opposite the spring end that engages the threaded cap 160 is a fixed end 168 (supported on the truck bed) that receives the compression force, for example, from a load supported by the suspension system of the locomotive 122 (shown in FIG. 2).

Thus, as illustrated by FIGS. 5 and 6, as the threaded cap 160 is rotated in a counterclockwise direction (represented by the arrow CCW), more turns of the spring 132, such as one more coils 138 of the spring 132 are engaged by the threaded cap 160 and arrested therein. For example, the threaded cap 160 may operate similar to a closed end nut such that rotation causes more of the spring 132 to be engaged within the threads 166 in a friction fit manner. As can been seen, more of the coils 138 of the spring 132 are retained within the threaded cap 160 in FIG. 6 (after counterclockwise rotation of the threaded cap 160) than in the threaded cap 160 in FIG. 5. Thus, the stiffness of the spring 132 is lower in FIG. 5 than in FIG. 6 because the number of active coils 138 of the spring 132 in FIG. 5 is greater than the number of active coils 138 of the spring 132 in FIG. 6. Thus, in various embodiments, the amount of compression force supported by the spring 132 changes as the stiffness changes.

In particular, the stiffness of the spring 132 may be defined in the following Equation 1:

$$k = \frac{d^4 G}{8D^3 N}$$

Wherein k represents the stiffness, d=the cross-section diameter of the spring 132, D=the diameter of the spring 132, and N=the number of active coil turns of the spring 132.

In operation, with an increase in the number of active turns (N), the stiffness decreases and with a decrease in the number of active turns (N), the stiffness increases. Thus, the threaded cap 160 can be actuated or driven, such as in a closed loop, to adjust the number of coil turns that are active, thereby changing the stiffness of the spring 132. By adjusting the stiffness of different springs 132, the load or weight of a locomotive may be redistributed as described herein. Thus, by locking a portion of the spring 132 within the threaded cap 160, that portion of the spring 132 becomes ineffective or inactive. As the stiffness of the spring 132 is increased, the load on other springs corresponding to other axles decreases with the load on the stiffened spring increased.

Accordingly, the threaded cap 160 operates with the spring 132 to adjust the stiffness of the spring 132. For example, some turns of the spring 132 are in the threads 166 of the threaded cap 160. The threaded cap 160 holds the spring 132 at one end with the other end of the spring 132 being fixed. By turning or rotating the threaded cap 160 in one direction (illustrated as counterclockwise), a greater number of coil turns are provided and maintained within the threaded cap 160, which decreases the number of active coils 138, thereby increasing the stiffness of the spring 132. By turning the threaded cap 160 in the opposite direction (in the clockwise direction in this example), the number of coil turns in the threaded cap 160 is decreased, which increases the number of active coils 138, thereby decreasing the stiffness of the spring 132. It should be noted that the actuation and movement of the threaded cap 160 can be provided and regulated by any device, such as a motor, etc.

In other embodiments, for example, as illustrated in FIG. 7, the spring retainer 140 is configured having outer threads. In this embodiment, the spring retainer 140 includes a threaded bolt 170 (or threaded screw) that is capable of rotation. The threaded bolt 170 includes threads 172 for receiving the coils 138 of the spring 132 and locking the received coils 138 in place, such that coils 138 are arrested and inactive. In this embodiment, the threaded bolt 170 is positioned within the coils 138 of the spring 132. As shown, only a portion of the threaded bolt 170 includes threads 172 (illustrated at a top of the threaded bolt 170) for arresting a portion of the spring 132 by locking, for example, certain coils 138 is a fixed position. The spring retainer 140 including the threaded bolt 170 is shown mounted within the axle box 134. However, it should be noted that variable spring stiffness arrangement 130 with the spring retainer 140 may be configured and positioned in different locations of the locomotive in connection with the suspension.

In this embodiment, the threaded bolt 170 is supported at a bottom end by the housing of the truck frame. The other end of the threaded bolt 170 is inserted through an opening within the axle box 134 and coupled with a support bearing 178. Each of the threaded bolts 170 is connected at the upper end to a motor 180 via a sprocket 182 and chain drive 184. It should be noted that the motor 180 may be any type of motor, for example, an electric motor, that causes the threaded bolts 170 to rotate using the chain drive 184. Additionally, the connection mechanism for connecting the motor 180 to the threaded bolts 170 may be any suitable coupling means, such as a belt drive, etc. It should be noted that a similar drive mechanism may be used for rotating the threaded cap 160 shown in FIGS. 5 and 6.

In operation, by rotating the threaded bolts 170, the number of arrested coils 138*a* is changed, which varies the stiffness of the spring 132 as described herein. Thus, by changing the number of ineffective or inactive coils 138, the stiffness of the spring 132 is varied, which changes the load on the springs 132.

Figure 8:
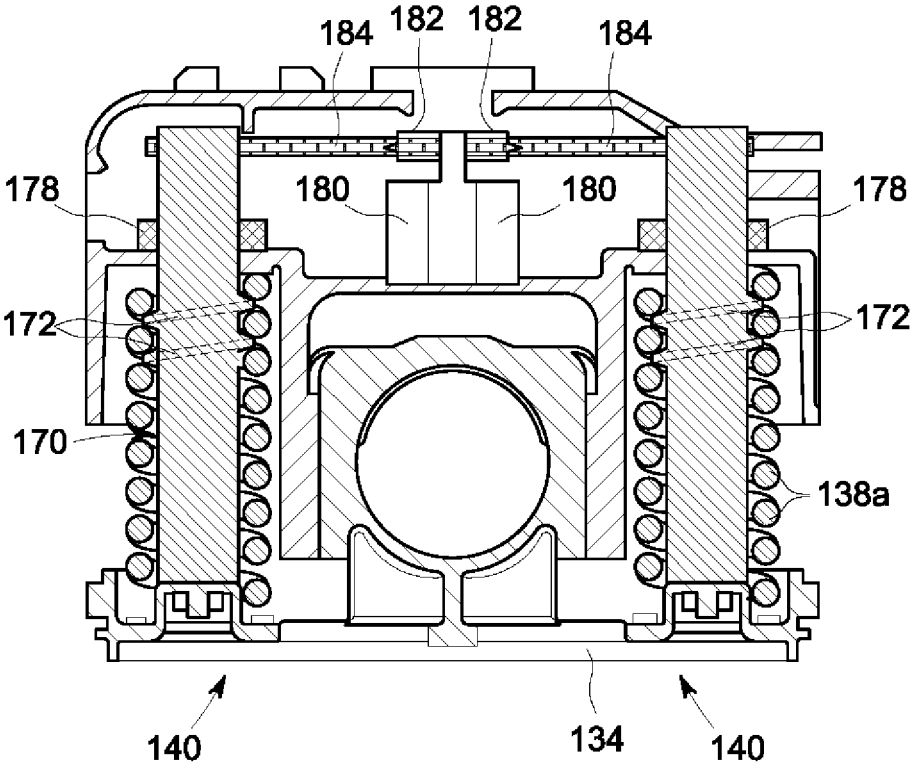
FIG. 8 is a cross-sectional view of another spring retainer formed in accordance with various embodiments within a vehicle suspension.

It should be noted that separate actuating mechanisms may be provided in connection with each of the springs 132 as illustrated in FIG. 8. Also, the number of components may be changed. For example, although two motors 180 are shown in FIG. 8, only one motor 180 may be provided.

Thus, by changing the stiffness of the outer springs 132 of the locomotive 122, weight management is provided by redistributing the load among the axles 118 of the locomotive 122. For example, assuming the following initial conditions, the various embodiments operate to provide weight management as described below:

K1 is the initial stiffness of all the springs 132.

FL1 is the free length of all springs 132 in a normal operating condition.

Delta1 is the deflection of truck platform. It should be noted that all springs deflect equally (delta1=F/3K1)

Each spring also takes an equal load (F/3).

It should be noted that the outer springs 132 of the locomotive suspension corresponding to the outer axles 118 may have extra coil turns (e.g., four extra turns) as compared to the springs 132 of the inner axles 118. The extra coil turns can be provided between the supported ends of the variable spring stiffness arrangement 130 using the spring retainer 140.

In operation, weight management may be provided as follows:

1. Initially all of the springs have a free length FL1, and a spring stiffness K1. The total initial stiffness of all springs is 3*K1.

2. Under the load (F), all of the springs deflect by an equal amount: delta1=F/(3*K1), such that the load taken by each of the springs=F/3.

3. For the outer springs, by turning the spring retainer 140, a greater number of coil turns are inserted between the truck and spring retainer 140. As a result, because of the increase in the number of coil turns between the spring retainer 140 and the truck platform, the outer suspension free length is changed by the spring retainer 140 from FL1 to FL2 (FL1<FL2; K2<K1).

4. Because of the increase in the number of active coil turns (N), there is a reduction in the stiffness of outer suspension from K1 to K2 (as described in connection with Equation 1 herein), such that K2<K1. The total changed stiffness of all of the springs is 2*K2+K1.

Thus, the total initial stiffness of all springs is 3*K1 which is greater than the total changed stiffness of all springs, which is 2*K2+K1.

Accordingly, the change in stiffness results in the following redistribution of load:

1. In the changed final condition, after the application of load F, the truck platform remains parallel to the ground with the free ends of all of the springs at an equal distance from the ground.

2. If the middle or inner spring deflects by an amount delta2, the outer springs deflect with the value delta2+(FL2−FL1) because the free length of the outer springs (FL2) is now more than the free length of the inner spring (FL1).

3. The load taken by the outer suspension is Lo=K2*(delta2+(FL2−FL1)) and the load taken by the inner or middle suspension is Lm=K1*delta2.

4. The effect of preload (K2*(FL2−FL1)) on the outer suspension causes the outer suspension to support a large portion of the load (F).

5. The load taken by inner or middle springs is: Lm=K1*delta2 and the load taken by outer springs is: Lo=K2*(delta2+(FL2−FL1)).

Thus, for example, assuming four suspensions at each end and the load F is increased by four times from 52.5 klbs to 210 klbs., the outer suspension load is increased from 70 klbs (17.5×4) to 90 (22.5×4) klbs and the inner or middle suspension load is reduced from 70 klbs (17.5×4) to 30 (7.5×4) klbs.

Figure 9:
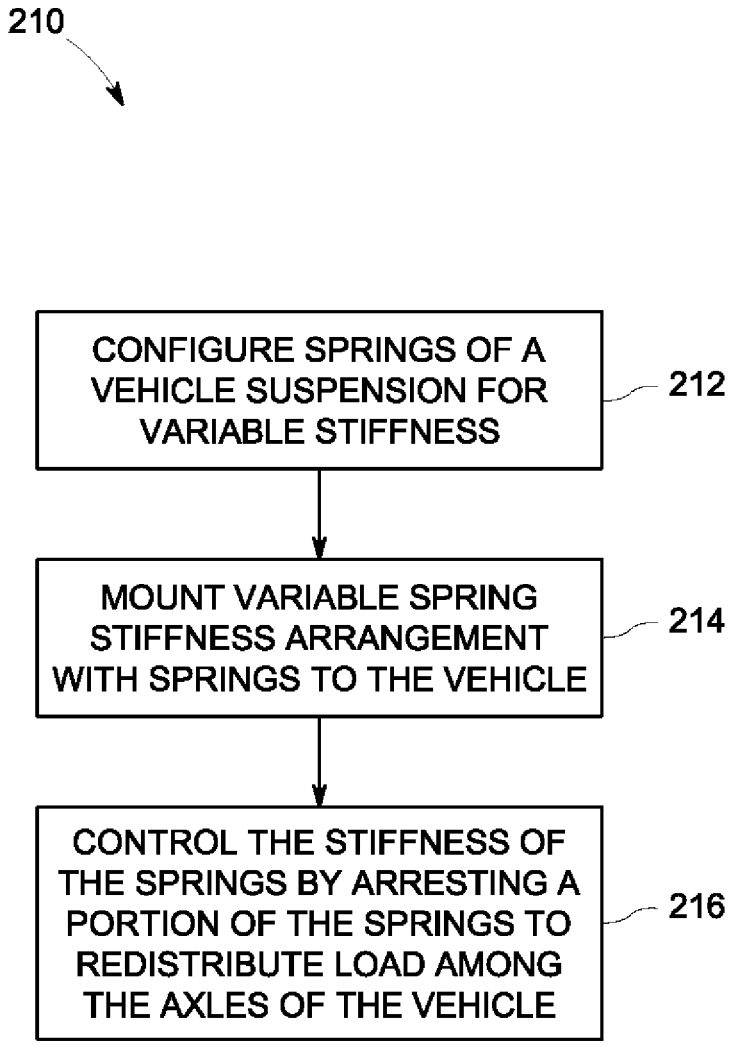
FIG. 9 is a flowchart of a method to dynamically redistribute weight in a vehicle in accordance with various embodiments.

A method 210 as shown in FIG. 9 also may be provided to dynamically redistribute weight in a vehicle. The method 210 includes configuring springs of a vehicle suspension for variable stiffness at 212. For example, a mechanism for varying a portion of the springs that are arrested to make that portion of the springs inactive or ineffective may be provided using a variable spring stiffness arrangement as described herein.

The method 210 then includes mounting the variable spring stiffness arrangement to the vehicle at 214. For example, springs having the variable spring stiffness arrangement may be mounted to the vehicle or a portion thereof, such as the axle box. In some embodiments, the variable spring stiffness arrangement is provided on springs of the outer axles and not on the inner axle of a three axle truck, with two trucks provided per vehicle.

With the variable spring stiffness arrangement mounted with the springs, the stiffness of the springs is controlled at 216 by arresting a portion of the springs. For example, by varying the number of active spring coils, the stiffness of the springs is changed, which redistributes the load among the axles of the vehicle. The controlling may be provided using a control module that dynamically adjusts the number of coil turns of the springs that are arrested. The changes to the stiffness may be based on different factors, such as traction limited modes of operation.

Thus, various embodiments may dynamically control weight distribution by varying the spring stiffness in a vehicle. For example, by varying a number of coil turns that are ineffective or inactive, which may be performed by arresting a number of coil turns, the stiffness of the springs is changed.

The various embodiments may be implemented with no changes to the vehicle frame. For example, the motor and the variable spring stiffness arrangement can be mounted on the vehicle frame on either the inside or outside of the frame.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the above subject matter, including the best mode, and also to enable any person skilled in the art to practice the embodiments of subject matter, including making and using any devices or systems and performing any incorporated methods. The patentable scope of the subject matter described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A vehicle suspension, comprising:

a plurality of springs;

a plurality of spring retainers configured to adjust a number of inactive coils of the plurality of springs, wherein the plurality of springs comprises outer axle springs and inner axle springs, and wherein the plurality of spring retainers are coupled only to the inner axle springs;

a motor connected to the plurality of spring retainers and configured to actuate the spring retainers to adjust the number of inactive coils of the plurality of springs; and a controller coupled to the motor to control the motor to actuate the spring retainers to adjust the number of inactive coils of the plurality of springs to vary the stiffness of the plurality of springs.

2. The vehicle suspension of claim 1, wherein the controller dynamically controls the motor to actuate the spring retainers to adjust the number of inactive coils of the plurality of springs based on operating conditions.

3. The vehicle suspension of claim 1, wherein the plurality of spring retainers comprise threaded caps having inner threads for engaging coils of the plurality of springs.

4. The vehicle suspension of claim 3, wherein the threaded caps comprise an open end for receiving the spring therein and a closed end for limiting a maximum number of inactive coils.

5. The vehicle suspension of claim 1, wherein the plurality of spring retainers comprise threaded bolts having outer threads for engaging coils of the plurality of springs.

6. The vehicle suspension of claim 5, wherein the outer threads extend along only a portion of the threaded bolts.

7. The vehicle suspension of claim 1, wherein the plurality of spring retainers comprises threads configured to engage coils of the plurality of springs.

8. The vehicle suspension of claim 7, wherein the motor is connected to the plurality of spring retainers to rotate the plurality of spring retainers.

9. The vehicle suspension of claim 8, wherein the plurality of spring retainers are configured to arrest coils of the plurality of springs to adjust the number of inactive coils.

10. The vehicle suspension of claim 1, wherein the plurality of springs are fixed at an end opposite the plurality of spring retainers.

11. A vehicle system, comprising:

a frame configured to receive a plurality of axles, each of the axles having a corresponding spring suspension system with a plurality of springs;

a traction motor coupled to at least some of the plurality of axles;

a plurality of spring retainers configured to vary a stiffness of the plurality of springs;

a motor connected to the plurality of spring retainers and configured to move the spring retainers to adjust a number of arrested coils of the plurality of springs to vary the stiffness of the plurality of springs; and a controller coupled to the motor to control the motor to move the spring retainers to adjust the number of arrested coils of the plurality of springs to vary the stiffness of the plurality of springs.

12. The vehicle system of claim 11, wherein the controller dynamically controls the motor to move the spring retainers to adjust the number of arrested coils of the plurality of springs to vary the stiffness of the plurality of springs based on operating conditions.

13. The vehicle system of claim 11, wherein the plurality of spring retainers comprises threaded caps having inner threads for engaging coils of the plurality of springs.

14. The vehicle system of claim 11, wherein the plurality of spring retainers comprises threaded bolts having outer threads for engaging coils of the plurality of springs.

15. The vehicle system of claim 14, wherein the outer threads extend along only a portion of the threaded bolt.

16. The vehicle system of claim 11, wherein the motor is connected to the plurality of spring retainers to cause rotation of the plurality of spring retainers.

17. The vehicle system of claim 11, wherein the traction motor is coupled only to outer axles and the plurality of spring retainers are coupled to spring suspensions corresponding to the inner axles and the plurality of spring retainers vary a stiffness of the plurality of springs to redistribute a load from an inner axle to the outer axles of the plurality of axles.

18. A method for dynamically redistributing weight in a vehicle, the method comprising:

configuring a plurality of springs of a vehicle system suspension for variable stiffness;

mounting a variable spring stiffness arrangement with the plurality of springs to the vehicle system; and controlling a stiffness of the plurality of springs by arresting at least a portion of some of the plurality of springs to provide load redistribution among axles of the vehicle system suspension, including controlling the stiffness of the springs in an inner suspension connected to an inner axle having no traction motor and wherein outer suspensions connected to outer axles include traction motors.

19. The method of claim 18, further comprising using a threaded spring retainer that is configured to engage coils of the plurality of springs to control the stiffness.

20. The method of claim 18, further comprising controlling the spring stiffness based on a traction limited mode of operation using a control module.

* * * * *